US005375629A

United States Patent [19]

Wilson

[11] Patent Number: 5,375,629

[45] Date of Patent: Dec. 27, 1994

[54] ACETAL FUEL FILTER FABRIC

[75] Inventor: Charles F. Wilson, Nicholson, Ga.

[73] Assignee: Synthetic Industries, Inc., Chickamauga, Ga.

[21] Appl. No.: 107,936

[22] Filed: Aug. 17, 1993

[51] Int. Cl.[5] ..... D03D 15/00

[52] U.S. Cl. ..... 139/383 R; 139/420 A; 210/499

[58] Field of Search ..... 210/499; 139/383 A, 139/420 A, 383 R

[56] References Cited

U.S. PATENT DOCUMENTS 3,568,846 3/1971 Haefner .
4,114,130 9/1978 Sutton et al. .
4,305,416 12/1981 Henning et al. .
4,961,850 10/1990 Combest .
5,014,755 5/1991 Bompard et al. ..... 139/420 A
5,049,271 9/1991 Cain .
5,085,768 2/1992 Murakami et al. .

FOREIGN PATENT DOCUMENTS 2097941 5/1987 Japan ..... 139/420 A

OTHER PUBLICATIONS

Modern Plastics Encyclopedia 1983–1984, p. 9, Sinker, S. M., "Acetal Copolymer".

*Primary Examiner*—Andrew M. Falik
*Attorney, Agent, or Firm*—Renner, Kenner, Greive, Bobak, Taylor & Weber

[57] ABSTRACT

A fabric (16) is formed from a plurality of woven monofilaments, comprising an acetal resin, the fabric having utility as a fuel filter fabric. The acetal resin presents a material that is stable and does not swell in alternative fuels.

2 Claims, 1 Drawing Sheet

ACETAL FUEL FILTER FABRIC

TECHNICAL FIELD

The present invention relates to the art of fuel filters. More particularly, the invention relates to a fuel filter fabric which can be used in alternative fuels. Specifically, the invention relates to a woven acetal fabric which can be employed in fuel filters that operate in alternative fuels.

BACKGROUND OF THE INVENTION

Acetals are polymers of formaldehyde which are technically known as polyoxymethylenes. Heretofore, these thermoplastic polymers have been used extensively in various injection molding and tubing applications. In particular, acetals have been used in the automotive industry to make molded automobile parts ranging from door handles to fuel tank caps. In addition, the housing components of current fuel filter assemblies are typically made from acetal.

Other automobile components which may be made from acetal are the subject of various patents such as U.S. Pat. No. 4,114,130 which discloses an acetal casing for a float operated fuel level sender; U.S. Pat. No. 4,305,416 which discloses a back-up fuel tank composed of polyacetal; U.S. Pat. No. 5,049,271 which discloses a fuel tank filter having a solidly constructed separator made from acetal resin to hold the porous filter toward the bottom of the tank; and U.S. Pat. No. 5,085,768 which discloses a fuel tank having a plastic magnet formed by adding a magnetic powder to an acetal resin.

In addition to having high load bearing and excellent durability characteristics, acetals generally have excellent physical properties for filtration. Some of these properties are noted in U.S. Pat. No. 3.568,846 which relates to an improved filter media prepared from discrete particles of plastic material having irregular, nonuniform shaped surfaces. The plastic materials include such materials as polyoxymethylenes, also known as polyacetals.

Fuel filters are commonly employed in vehicular fuel systems to separate any undesirable contaminants from the fuel required for the operation of the vehicle's engine. Most, if not all, fuel filters today use some type of fabric within the fuel filter to preclude flow of any unfiltered fuel into the engine which could subsequently damage the engine.

Woven fabrics of various compositions have long been known and used in fuel filters. For example, U.S. Pat. No. 4,961,850 discloses the use of woven threads of nylon or Saran, a polyvinylidene chloride thermoplastic polymer and a trademark of the Dow Chemical Company. In that patent, the woven fabric was used in an in-tank fuel filter to filter gasoline in the vehicular fuel system.

However, none of the present compositions of fabric have been able to meet the stringent requirements for flex fuel filtration in vehicles such as automobiles. While most, if not all, of the present compositions for fuel filter fabrics perform well in conventional fuel systems which use gasoline as the fuel, the same cannot be said for those same compositions and fuels filter fabrics where alternative fuels are used in the fuel system.

Specifically, alternative fuels such as methanol, ethanol, and grain alcohol are rapidly being developed for use in vehicular fuel systems. However, these alternative fuels cause the currently developed fabrics used in the fuel filters to swell and starve the engine of fuel.

Thus, a need exists liar a fuel filter fabric which can readily be welded to the housing component of the fuel filter, and whose monofilaments or fibers will not be affected by the presence of alternative fuels, so as to starve the engine of fuel or allow a contaminant to pass through the fuel filter.

SUMMARY OF THE INVENTION

It is therefore, an object of the present invention to provide a fabric which is not affected by the presence of alcohol or other alternative fuels.

It is another object of the present invention to provide a fabric, as above, which can be used in a fuel filter for alternative fuels.

It is yet another object of the present invention to provide a fuel filter which will function properly when alternative fuels are used.

It is still another object of the present invention to provide a fuel filter fabric which can readily be welded to the housing of a fuel filter.

It is yet another object of the present invention to provide a method for producing a woven fabric which will not be affected by alternative fuels.

It is a further object of the present invention to provide a method for producing a fuel filter comprising a fabric which will function properly when alternative fuels are used in the vehicular fuel system.

At least one or more of the foregoing objects, together with the advantages thereof over the existing art, which shall become apparent from the specification which follows, are accomplished by the invention as hereinafter described and claimed.

In general the present invention provides a fabric for use in alternative fuels which comprises a plurality of woven monofilaments, the monofilaments comprising acetal resin.

The preferred fuel filter assembly incorporating the concepts of the present invention is shown by way of example in the accompanying drawings without attempting to show all of the various forms and modifications in which the invention might be embodied, the invention being measured by the appended claims and not by the details of the specification.

PREFERRED EMBODIMENT FOR CARRYING OUT THE INVENTION

Figure 1:
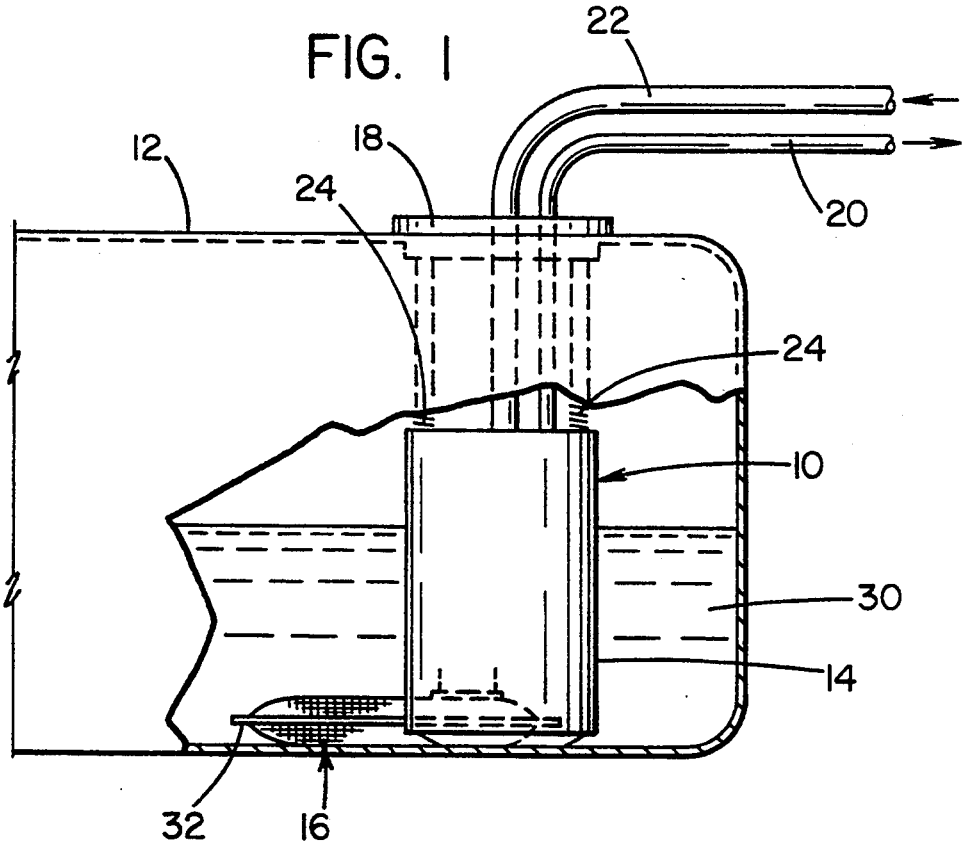
FIG. 1 is a diagrammatic side elevational view, with a portion broken away, of a fuel tank including an in-tank fuel filter according to the present invention.
Figure 2:
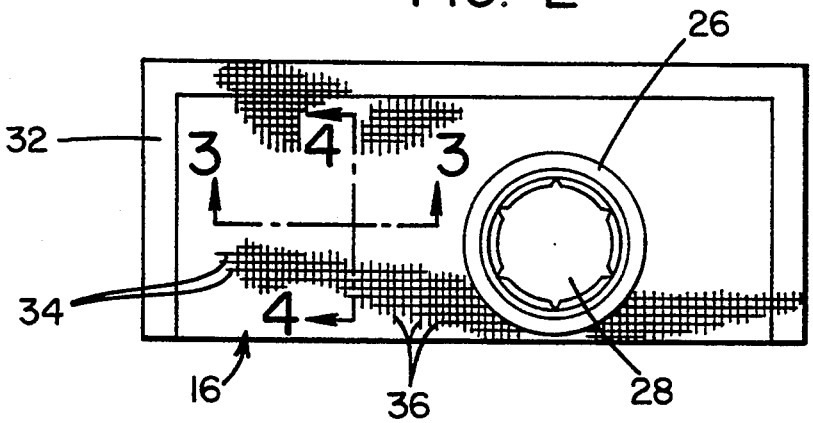
FIG. 2 is a top plan view of the fuel filter of FIG. 1 showing the fuel filter fabric of the present invention.

One representative form of a fuel filter assembly embodying the concepts of the present invention is indicated generally by the number 10 in FIG. 1 of the accompanying drawings. It is contemplated that the fuel filter assembly 10 would be positioned within a fuel tank 12 although, of course, the invention is not intended to be limited to any particular position in the vehicular fuel system. Notably, in-line fuel filters are also contemplated.

Referring to FIG. 1, the Fuel filter assembly 10 includes, as its basic components, a housing 14, and a fabric 16. The housing 14 is conventional and representative of the general class of housings or casings utilized in the fuel filter art. As is well known for conventional in-tank fuel filter assemblies, the housing 14 may have a sealing cap 18 which engages the top of fuel tank 12 and through which extends at least a fuel line 20 and an overflow return line 22. Other hoses (not shown) may also extend through the sealing cap 18. For instance, there is typically a vapor line for ventilation as well as a line to provide electrical current to the fuel filter assembly 10 as may be required. The fuel line 20 is securely connected to the housing 14 and extends through the sealing cap 18 and leads to the engine (not shown) of the vehicle as is also well known in the art. Tension springs 24 extend between the sealing cap 18 and housing 14 to support the fuel filter assembly 10.

The fabric 16 is connected to the housing 14 by a sealing rim 26, integrally connected to the fabric 16 and attachable to the housing 14. A fuel withdrawal opening 28 through which fuel 30 is drawn into the fuel filter assembly 10 is defined by the sealing rim 26. However, in order to do so, the fuel 30 must pass through the fabric 16. Hence, the fabric 16 acts as the filter to separate undesirable particles from the fuel 30.

The fabric 16 of the present invention may have any configuration known in the art as suitable for filtration purposes. In the preferred embodiment the fabric 16 is essentially folded over itself and sealed together at seam 32. This configuration creates a type of filter fabric well known in the art.

Figure 3:
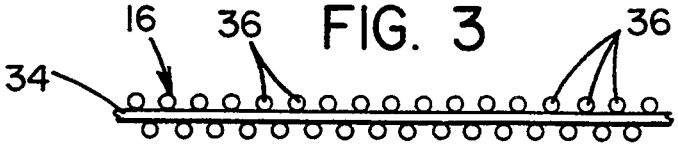
FIG. 3 is an enlarged sectional view taken substantially along the line 3—3 of FIG. 2.
Figure 4:
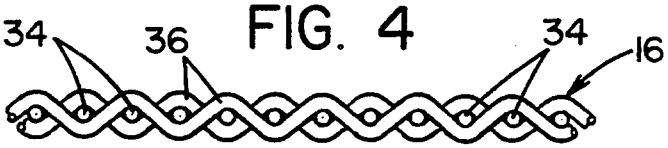
FIG. 4 is an enlarged sectional view taken substantially along the line 4—4 of FIG. 2.

As shown in FIGS. 3 and 4, the fabric 16 comprises at least two sets or systems of monofilaments 34, 36 of material which may be woven using any standard weave as is known in the art. Preferably, the monofilaments 34, 36 of the fabric 16 are interlaced together in a perpendicular configuration (warp and filling directions) to each other and simultaneously or subsequently treated, so that the monofilaments of one set 34 extending in one (warp) direction are generally straight, while the monofilaments of the other set 36 are locked in their interlaced position with the first set of monofilaments 34. However, it is not intended that the monofilaments 34, 36 of the fabric 16 be limited to this particular manner of interlacing or interlacing in those particular directions.

Any weave known in the art may be used in weaving the monofilaments 34, 36 to create the fabric 16. The most common types of weaves for filtration applications are plain, twill and satin weaves, or derivatives of these, all of which are used and understood by those skilled in the art.

As noted hereinabove, the fabric 16 of the fuel filter assembly 10 is unique in that it provides a fuel treating media or material which, unlike conventional fuel filter fabric, is stable in alternative fuels, especially those which contain alcohol. By "stable," it is meant that the fabric is not affected by the presence of alternative fuels and that certain physical properties associated with the size or porosity of the fabric remain essentially the same even after it has been subjected to alternative fuels. For example, when a flow of air is passed through the fabric 16 after being subjected to an alcohol environment, the rate of flow may change up to about 5 percent; however, when the same test is performed on a conventional fuel filter fabric such as nylon, the rate of flow may increase by at least 20 percent.

Other physical properties of the fabric 16 of the present invention are significantly enhanced by the presence of acetal resin in the monofilaments 34, 36 of the fabric 16. As discussed hereinabove, acetal resins are polyoxymethylene thermoplastic polymers, or more broadly, polymers of formaldehyde which are generally obtained by a variety of methods. Compared to other thermoplastics, acetals have high rigidity and mechanical strengths. They also are known to have excellent resilient properties as well as high fatigue strength and good dimensional stability. Additionally, they are tough over a broad range that includes both high and low temperatures.

Important to the present invention, acetals are highly resistant to and not affected by many chemical reagents such as neutral oils, grease, petroleum-based fuels, alcohols and many other organic solvents including esters, ketones, and aliphatic and aromatic hydrocarbons. Therefore, they are effective in maintaining their rigidity, strength and other physical characteristics necessary for use in fuel filter fabrics of flex fuel filtration. As indicated hereinabove, while other media or material compositions have been known to affect the size, diameter and/or porosity of the fabric when placed in alternative fuels, acetal does not.

A particularly useful and preferred acetal resin is Celcon, a highly crystalline acetal copolymer based on trioxane (trimmers of formaldehyde) produced by Hoechst Celanese. "Celcon" is a trademark of Celanese Chemical Company. As noted previously, Celcon, as well as other acetal resins, has many applications including use in the automotive industry. Celcon is particularly suitable as the material from which the housing 14 and sealing rim 26 of the filter 10 of the present invention may be molded using such techniques as injection molding. However, the housing 14 and the sealing rim 26 of the present invention are not intended to be limited to this particular material. Nor, is it contemplated that injection molding be the sole technique for fabricating the housing 14 and sealing rim 26. Other techniques known to those skilled in the art are adequate techniques as well.

Nevertheless, for those fuel filter assemblies which have housings and sealing rims made from acetal, the use of the unique fabric of the present invention also made from acetal provides a further advantage in that, because the filter fabric and sealing rim components are chemically identical, the filter fabric can be welded to the sealing rim much easier, thereby reducing manufacturing time and resulting in an improved bonding of the fabric to the sealing rim.

The acetal monofilaments of the fabric 16 are generally prepared by the extrusion of acetal into a monofilament yarn. As described hereinabove, at least two sets of strands of the acetal monofilament yarn are then interlaced together to form the fabric of the present invention.

In operation then the fuel filter assembly 10 separates contaminants and other undesirable particles from the fuel within the vehicular fuel system to preclude the contaminants and particles from damaging the engine. More specifically, the fuel 30 in the fuel tank 12 is siphoned or drawn through the interstices of the fabric 16 and into the fuel filter 10. From there, the fuel 30 enters the fuel line 20 which takes it to the engine.

In order to demonstrate an important characteristic of the invention, i.e., that the size and porosity of the fabric are not affected by the presence of alternative fuels, four hand samples of the fabric of the present invention made of acetal resin (Celcon) and four hand samples of a fabric of conventional nylon (Nylon-6) were cut in half and their original weights (in grams) recorded as shown in Table I hereinbelow. One half of each sample was then subjected to an air flow test whereby air was passed through it and the amount of air passing therethrough was recorded in cubic feet per minute as also shown in Table I. Next, one half of each sample was placed into isopropyl alcohol and the other half was placed into a gasoline/alcohol mixture comprising about 85 percent by weight gasoline and about 15 percent by weight alcohol. All of the samples were totally submerged and remained in these fuels for 24 hours. Then, the samples were removed, patted dry and weighted. The weights of each were recorded in Table I. Each half of the samples were also subjected to the flow rate test as described hereinabove, again. The flow of air through each sample half was again recorded in Table I hereinbelow.

TABLE I

A. ISOPROPYL ALCOHOL TESTING

| NYLON | | | | | CELCON | | | | |
|---|---|---|---|---|---|---|---|---|---|
| WEIGHT (grams) | | FLOW (cubic feet/minute) | | | WEIGHT (grams) | | FLOW (cubic feet/minute) | | |
| Original | After | Original | After | flow change | Original | After | Original | After | flow change |
| 3.29 | 3.30 | 107 | 142 | 35 | 3.62 | 3.63 | 199 | 201 | 2 |
| 3.28 | 3.29 | 105 | 134 | 29 | 3.66 | 3.68 | 235 | 235 | 0 |
| 3.29 | 3.31 | 110 | 150 | 40 | 3.64 | 3.64 | 85 | 89 | 4 |
| 3.40 | 3.41 | 124 | 160 | 36 | 3.68 | 3.69 | 267 | 267 | 0 |

B. GAS WITH ALCOHOL TESTING (85% GAS WITH 15% ALCOHOL)

| NYLON | | | | | CELCON | | | | |
|---|---|---|---|---|---|---|---|---|---|
| WEIGHT (grams) | | FLOW (cubic feet/minute) | | | WEIGHT (grams) | | FLOW (cubic feet/minute) | | |
| Original | After | Original | After | flow change | Original | After | Original | After | flow change |
| 3.24 | 3.29 | 109 | 142 | 33 | 3.61 | 3.62 | 193 | 189 | −4 |
| 3.31 | 3.36 | 106 | 140 | 34 | 3.65 | 3.65 | 241 | 238 | −3 |
| 3.34 | 3.40 | 112 | 153 | 41 | 3.73 | 3.73 | 88 | 91 | 3 |
| 3.32 | 3.37 | 122 | 157 | 35 | 3.60 | 3.59 | 267 | 259 | −8 |

As can be seen from the Table, the fabric of the present invention was not affected by the presence of the alternative fuels. In fact, the most the rate of flow increased or decreased from its original rate of flow in any trial for the fabric of the present invention (Celcon) was about 5 percent. In contrast, the rate of flow for the Nylon fabric increased significantly. In fact, the small increase in the rate of flow for the Nylon fabric was more than 20 percent.

Thus it should be evident that the fuel filter of the present invention is highly effective in providing a fuel filter fabric which is stable in, and is not affected by alternative fuels, and therefore, does not starve the engine of fuel or allow contaminants to pass there through. The invention is particularly suited for fuel filters for vehicular fuel systems which can use alternative fuels to operate, but is not necessarily limited thereto. The fabric of the present invention can be used separately with other equipment, methods and the like, as well as for the manufacture of other filtering apparatus.

Based upon the foregoing disclosure, it should now be apparent that the use of the fabric described herein will carry out the objects set forth hereinabove. It is, therefore, to be understood that any variations evident fall within the scope of the claimed invention and thus, the selection of specific components in addition to acetal resins can be determined without departing from the spirit of the invention herein disclosed and described. In particular, the fabric of the present invention is not necessarily limited to those fabrics which use monofilaments of Celcon. Moreover, as noted hereinabove, other filtering means can be substituted for the in-tank fuel filter described. Thus, the scope of the invention shall include all modifications and variations that may fall within the scope of the attached claims.

What is claimed is:

1. A fabric for use in alternative fuels comprising:

a plurality of woven monofilaments, wherein at least two sets of said monofilaments are interlaced together such that said monofilaments of a first set, extending in one direction, are generally straight, while said monofilaments of at least a second set are locked in their interlaced position with said first set of monofilaments; said monofilaments comprising acetal resin.

2. A fabric, as set forth in claim 1, wherein said monofilaments are stable in alternative fuels.

* * * * *